US006519781B1

(12) United States Patent
Berns

(10) Patent No.: US 6,519,781 B1
(45) Date of Patent: Feb. 18, 2003

(54) ENERGY ABSORBING PROTECTIVE DEVICE THAT PROTECTS AREAS OF ARTICULATION

(75) Inventor: Jason Berns, Boulder, CO (US)

(73) Assignee: Salomon S.A. (FR)

( * ) Notice: Subject to any disclaimer, the term of this patent is extended or adjusted under 35 U.S.C. 154(b) by 0 days.

(21) Appl. No.: 09/948,255

(22) Filed: Sep. 7, 2001

(51) Int. Cl.[7] ..... A41D 13/00
(52) U.S. Cl. ..... 2/267; 2/455
(58) Field of Search ..... 2/267, 455, 16, 2/22–24, 2.5, 59, 459, 92, 456, 108, 69, 85, 62, 161.1, 465; 602/6, 12, 20, 23, 26; 428/67

(56) References Cited

U.S. PATENT DOCUMENTS 5,488,739 A * 2/1996 Cardinal ..... 2/16
5,500,955 A * 3/1996 Gongea ..... 2/24
5,675,844 A * 10/1997 Guyton et al. ..... 2/22
5,920,915 A 7/1999 Bainbridge et al.
5,996,115 A * 12/1999 Mazelsky ..... 2/2.5
6,029,273 A 2/2000 McCrane
6,055,676 A 5/2000 Bainbridge et al.
6,058,503 A * 5/2000 Williams ..... 2/16
6,079,056 A * 6/2000 Fogelberg ..... 2/267
6,093,468 A * 7/2000 Toms et al. ..... 2/22
6,301,722 B1 * 10/2001 Nickerson et al. ..... 2/22

FOREIGN PATENT DOCUMENTS

EP 0 880 908 A1 12/1998
WO WO00/16652 A1 3/2000
WO WO00/69293 A1 11/2000

* cited by examiner

*Primary Examiner*—John J. Calvert
*Assistant Examiner*—Tajash Patel
(74) *Attorney, Agent, or Firm*—Patton Boggs LLP

(57) ABSTRACT

An energy absorbing, articulated, protective pad with improved articulation for protection of areas of articulation, such as joints of a human body. A pad of energy absorbing material has score lines along a first axis and a second axis. The score lines are cut into said pad to provide articulation of the pad. The pad also has cuts along the second axis at the periphery of the pad that provide flexibility to the pad.

49 Claims, 5 Drawing Sheets

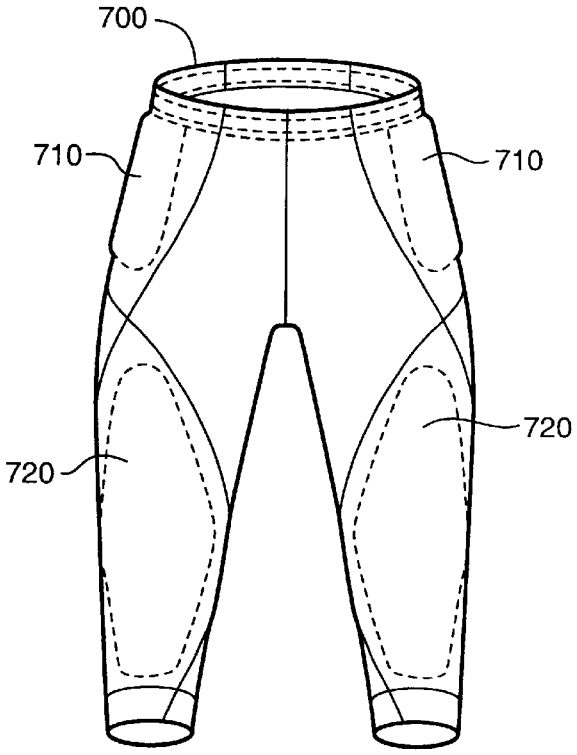
FIG. 7
FIG. 8
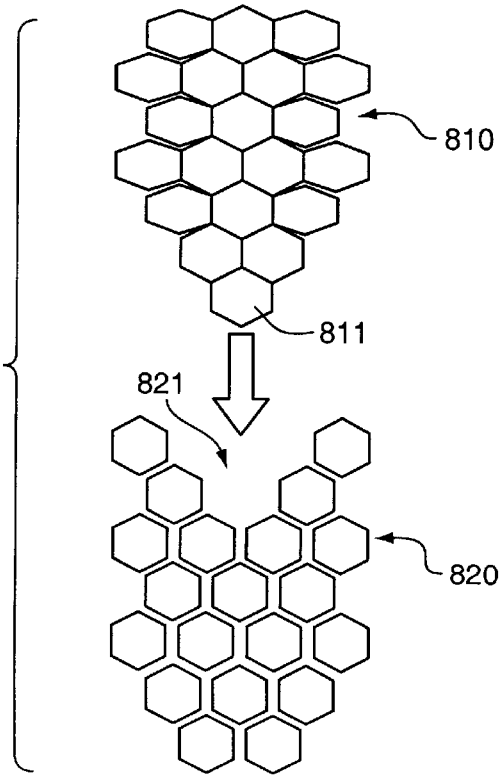

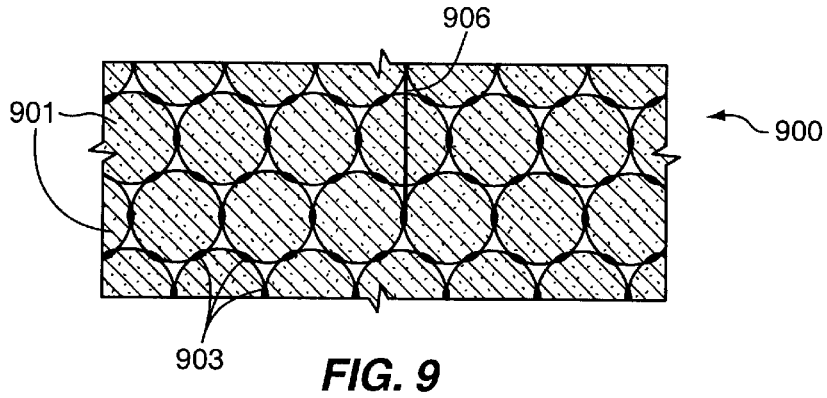
FIG. 9
FIG. 10
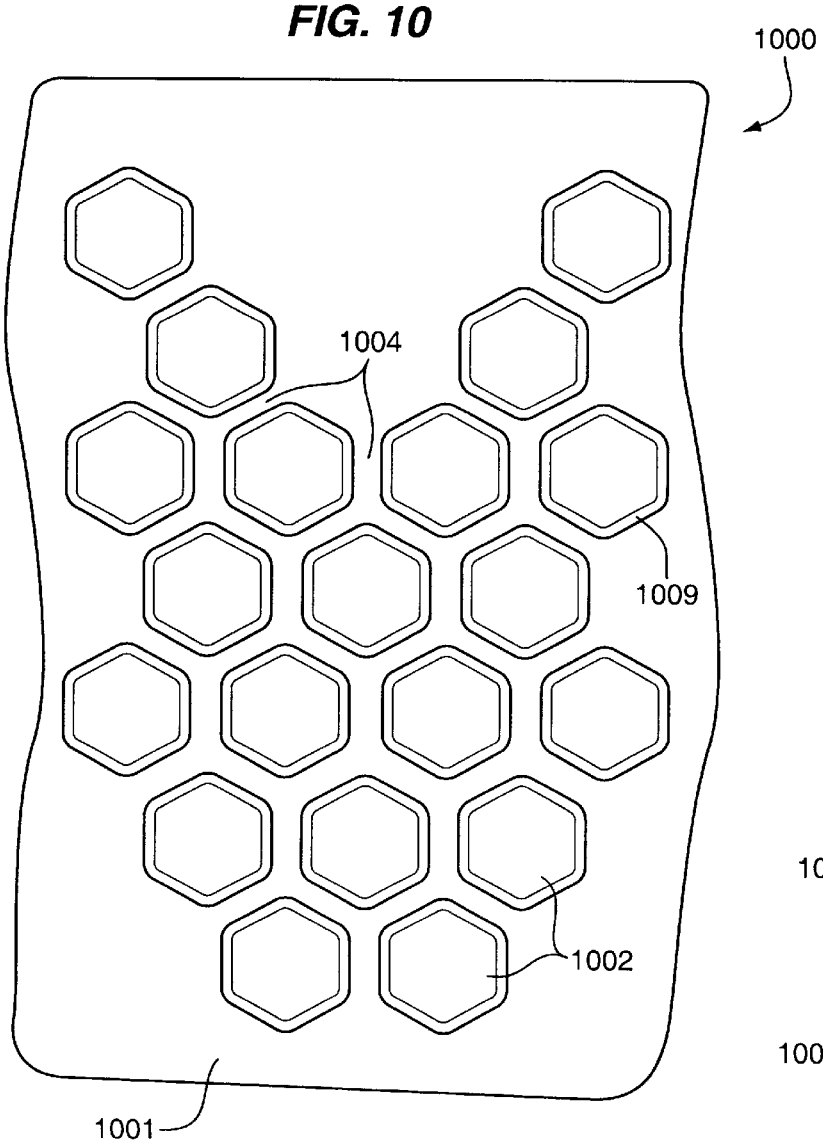
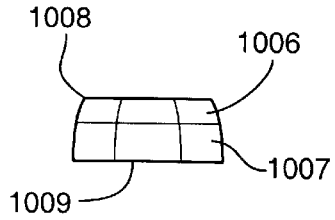
FIG. 11

ENERGY ABSORBING PROTECTIVE DEVICE THAT PROTECTS AREAS OF ARTICULATION

FIELD OF THE INVENTION

This invention relates to devices that absorb the energy of an impact. More particularly, this invention relates to devices used to provide protection to joints and other areas of articulation. Still more particularly, this invention relates to devices that provide protection to joints and other areas of articulation and allow air and moisture to pass through the protection to provide breathable protection to a user that allows evacuation of perspiration.

STATEMENT OF THE PROBLEM

Many sports and occupations require safety equipment such as padding that protects the users from impacts that occur. Some non-limitative examples of sports where padding is needed include bicycling, football, hockey, in-line skating, skiing and snowboarding. A non-limitative example of an occupation that requires safety equipment is construction. Designers of such safety equipment face a number of obstacles.

One area of particular concern to designers of safety equipment is padding. Of particular concern to the designers is padding for areas of articulation. An area of articulation is a joint or other area in which at least two adjacent body parts move in different directions during an activity. For example, one common joint to protect is the knee which must bend when a user is in-line skating, running, or walking. Users prefer padding that allows a full range of motion with minimal discomfort. Users also prefer padding that allows for the evacuation of perspiration, which is known as breathing in the art. Other concerns include that the padding is washable, lightweight and durable.

Prior art padding designs do not adequately meet these needs. One type of pad, such as the pad disclosed in U.S. Pat. No. 6,029,273 issued to McCrane, has a hard outer casing. This type of pad does not allow perspiration to escape. Therefore, this type of pad is not ideal for use in clothing. Further, this type of pad restricts movement, as the outer casing is rigid and inflexible. To allow articulation, some pads with rigid casings do provide articulated plates. Articulated cases include a plurality of plates fitted together that allow the plates to move with respect to one another in order to facilitate movement. These casings may solve the mobility problem. However, the casings with articulated plates still do not allow perspiration to escape, are heavy, bulky, and are still too rigid to insert into clothing. Furthermore, the cost of making the articulated plates is expensive and time consuming.

A second type of casing includes flexible, outer casings of porous, breathable inelastic material overfilled with resilient discrete beads of elastic material. An example of this type of pad is disclosed in U.S. Pat. No. 5,920,915 issued to Bainbridge et al. This material, while breathable, still impedes movement because the overfilled pads are semi-rigid. Therefore, this type is unacceptable for padding an articulated area.

A third type of pad is a foam pad that has score lines cut into the pad to facilitate movement. An example of this type of pad is disclosed in U.S. Pat. No. 6,093,468 issued to Tums et al. Score lines are indentations cut into the material. The cuts allow the foam of the pad to flex to allow the pad to flex. The foam material is breathable and allows perspiration to escape. The score lines improve the flexibility of a pad. However, the range of motion is still impeded as the score lines do not allow the pad to twist or form completely to an area due to the excess material.

It is, therefore, the desire of those skilled in the art to provide a pad that allows perspiration to escape and has a desired flexibility.

STATEMENT OF THE SOLUTION

The above and other problems are solved and an advance in the art is made by a protective pad made in accordance with this invention. A first advantage of a protective pad made in accordance with this invention is that the pad is breathable, meaning that perspiration is allowed to escape. Furthermore, the pad is washable as part of a garment. A second advantage of this invention is that the pad is flexible and may move with an area of articulation to allow a user a full range of motion with minimal discomfort.

In accordance with this invention, an energy absorbing protective pad has a pad of energy absorbing material. The pad has score lines along a first axis and a second axis. The score lines are cut into the pad to provide articulation. Along the second axis, the pad has cuts at the periphery of the pad. The cuts provide flexibility to the pad.

The energy absorbing material may be a foam or any other semi-rigid material. The foam may be single layered or multi-layered. Preferably, the energy absorbing material is a bi-density foam. The bi-density foam has a first layer on a bottom side of the pad having a first density and a second layer on a top side of the pad having a second density that is a higher density than the first density. The score lines are cut through the second layer of foam and through a substantial portion of the first layer. Preferably, the score lines are cut through three-quarters of the pad. However, the score lines may also be cut to any other depth including, but not limited to, one-half and one-quarter through the pad.

The inner side of the pad may be affixed to a piece of stretch or non-stretch fabric. The pad may be sewn or glued to the fabric. A piece of outer fabric may be affixed to the piece of stretch fabric around a perimeter of the pad to enclose the pad. The pad is not affixed to the outer fabric to add flexibility. When the pad is affixed to the stretch fabric, the score lines may completely sever the pad into a plurality of individual members.

The score lines may be cut into the pad in the following manner. A first plurality of score lines are cut into the pad substantially along a first axis. The first axis is substantially longitudinal with reference to the area of articulation being protected. For example, in a knee pad, the first axis would be substantially parallel to the leg. A second plurality of score lines are cut substantially along a second axis. The second axis is substantially perpendicular to the first axis. The first and second plurality of score lines define a plurality of polygons on the pad. The polygons are preferably narrower along the first axis than the second axis to promote flexibility along the first axis.

In a preferred embodiment, the cuts along the periphery of pad along second axis promote flexibility. The Cuts completely sever members at the periphery of the pad along the second axis to allow flexing of the pad. Polygons defined by cuts have reduced dimensions in the direction of the first axis to further promote flexibility and shaping of the pad to the member protected by the pad. The cuts also eliminate excess material in the direction of the first axis. The excess material is removed because this excess material impedes flexing of the pad in the direction of the first axis.

The pad may be molded to have a curvature traversing the second axis. A concave side of the pad is fitted to the area of articulation being protected. In a preferred embodiment, the energy absorbing material of the pad is heat moldable and heat is applied to the pad to form the curvature.

The protective pad may then be inserted in pockets or enclosures in a garment to form any number of pads. For example, a protective pad in accordance with this invention may be incorporated into a knee pad, a hip pad, a shoulder pad, or an elbow pad.

BRIEF DESCRIPTION OF THE DRAWINGS

The above and other advantages and features of this invention are set forth in the detailed description below and the following drawings:

FIG. 7 illustrating a pair of pants incorporating energy absorbing pads in accordance with the invention;

FIG. 8 illustrating a knee pad incorporating energy absorbing pads in accordance with the invention;

FIG. 9 illustrating a cross section of a foam pad in accordance with the invention;

FIG. 10 illustrating a pad in accordance with this invention attached to a stretch fabric; and FIG. 11 illustrating a cross sectional view of a member of a pad attached to a stretch fabric.

DETAILED DESCRIPTION

Figure 1:
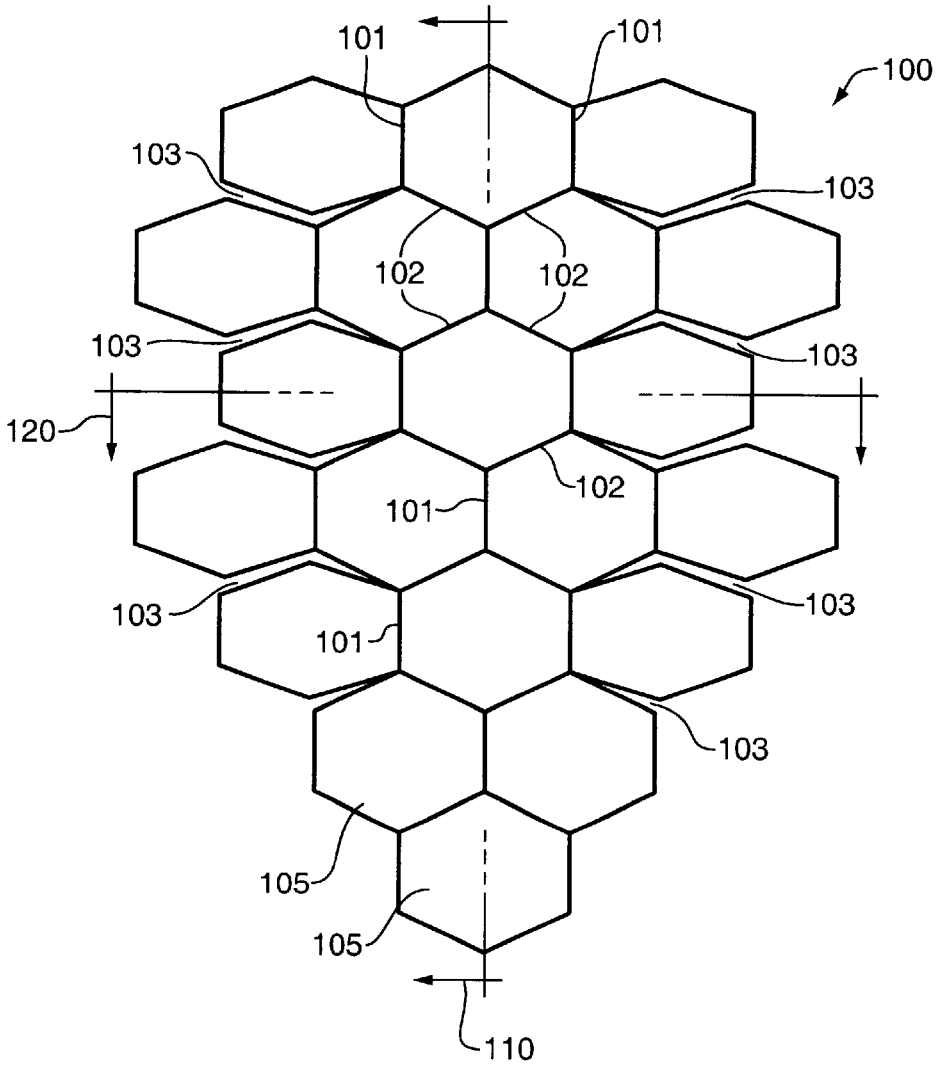
FIG. 1 illustrating an energy absorbing pad in accordance with the invention.
Figure 2:
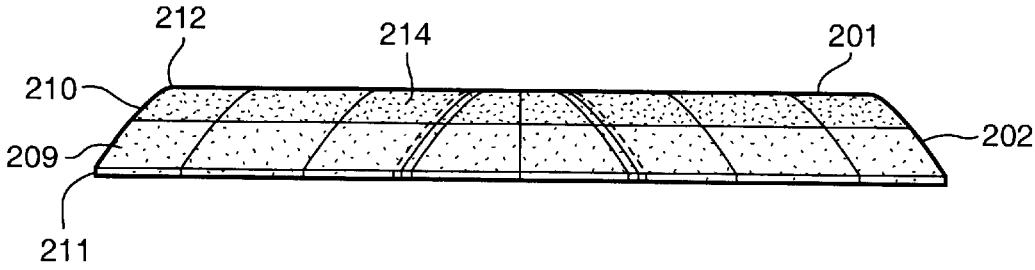
FIG. 2 illustrating a front view of an energy absorbing pad in accordance with the invention.

FIG. 1 illustrates a preferred embodiment of energy absorbing protective pad in accordance with the invention. Pad 100 is made of energy absorbing material. The energy absorbing material may be, but not limited to, a single density or multi-density foam. In a preferred embodiment, the energy absorbing material is a bi-density foam. An example of such a foam is described in WO Document No. 00/16652 by Brock, which is incorporated by reference as if set forth herein. FIG. 2 illustrates a cross section of a side view of pad 100 made of a bi-density foam. As can be seen in FIG. 2, pad 100 has a top side or outer layer 201 of high density foam. A second bottom side or inner layer 202 of foam is made of a lower density foam. Bi-density foam is preferred because the foam is breathable, elastic, and provides a softer surface close to the area to be protected and a harder surface on the side exposed to the source of trauma. FIG. 9 illustrates a cross sectional view of a piece of foam 900 that may be used in pad 100. The foam 900 is made of discrete beads 900 that are affixed to one at points 906. One skilled in the art will recognize that the beads may be melted together, glued together, or in some other way connected. The beads may be compressed to form a higher density foam. At the edges and on the surface of sides beads 903 are cut to provide a smooth surface.

Referring back to FIG. 1, pad 100 has a first, longitudinal axis 110 that is substantially longitudinal to an area of articulation being protected. For purposes of this discussion, an area of articulation is a joint or other area of a body in which at least two adjacent body parts move in different directions during an activity. Some examples of areas of articulation include, but are not limited to, knees, elbows, shoulders, and hips. For discussion purposes, the longitudinal axis is the line which essentially bisects the body parts that articulate. For example, a longitudinal axis of a knee is the line that bisects the two positions of the leg which are joined at the knee.

A second axis 120 traverses the area of articulation and intersects first axis 110. Preferably, second axis 120 of pad 100 is substantially perpendicular to the first axis 110 and traverses the area of articulation. Typically, second axis 120 is the shorter width of the pad.

Score lines 101 are articulation lines cut substantially along the first axis. Score lines 102 are articulation lines cut substantially along the second axis. Score lines 101 and 102 allow the pad to bend and flex to match the area of articulation protected. In the preferred embodiment, score lines 101 and 102 are cut to three-quarters (¾) the depth of the pad. Those skilled in the art will recognize that score lines may be cut to other depths including, but not limited to, one-half and one-quarter of the thickness of pad 100. Those skilled in the art will also recognize that score lines may be cut along any other axis in any other direction according to need.

Score lines 101 and 102 define individual members 105 of pad 100. Individual members 105 are in the form of polygons. In the preferred embodiment, the polygons are hexagonal to provide enhanced flexibility. Pentagonal polygons have also been found to have flexibility advantages. However, one skilled in the art will recognize that the polygons may be in any shape desired. Also, to promote flexibility of the joint, individual members 105 are preferably reduced in dimension along the first axis 110 than across the second axis 120. That is, because the individual members are narrower in a direction along the first axis than along the second axis, there are more score lines per unit length along the first axis, increasing flexibility.

To provide better flexibility, pad 100 also has cuts 103 along the periphery of pad 100 along second axis 120. Cuts 103 completely sever members 105 at the periphery of pad 101 along second axis 120 to allow flexing in pad 101. Polygons defined by cuts 103 have reduced dimensions in the direction of first axis 110 to further promote flexibility and shaping of pad 100 to the member protected by pad 100. Cuts 103 also eliminate excess material in the direction of first axis 110. The excess material is removed because this excess material impedes flexing of pad 100 in the direction of first axis 110.

Referring back to FIG. 2, individual members, such as 209, are preferably tapered in a direction from the bottom side toward the top, such as at 210. Individual members also have rounded edges, such as at 211 and 212. Preferably, the top layer 201 of all elements is tapered and rounded at all edges that are not connected to another element, such as at 214. The tapering and rounding increases flexibility, facilitates smooth interfacing of elements as they may contact during flexing, makes entry of a pad into a pocket easier, and gives a smooth, finished appearance to the pad.

Figure 3:
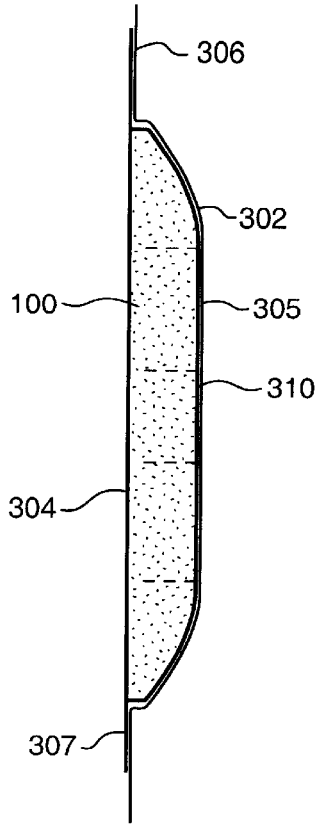
FIG. 3 illustrating a cross sectional side view of an energy absorbing pad affixed to fabric in accordance with the invention.

Sometimes pad 101 is affixed to a fabric for fitting into a garment. FIG. 3 illustrates a cross section of pad 100 along first axis 110 to show pad 100 affixed to a fabric. Pad 100 is affixed to a piece of stretch fabric 304. Preferably, pad 100 is glued or laminated to fabric piece 304, although pad 100 may be affixed to fabric piece 304 in other manners, such as sewing the pad to fabric piece 304. Fabric piece 304 is made of a lycra polyester blend or other stretch material that is lightweight, breathable, and flexible. A material such as Gore-Tex may also be used, although Gore-Tex is normally not stretchable. When pad 100 is affixed to fabric piece 304, score lines 101 and 102 may be cut completely through the pad to completely sever members 105 to maximize flexibility. FIG. 10 illustrates an example of members 105 being severed. In FIG. 10, a piece of stretch fabric 1001 has a plurality of members 1002 affixed to piece 1001 via glue 1009. Gaps 1004 between members 1002 allow piece of fabric 1001 to be flex freely. This allows the fabric to conform to an underlying body easily. FIG. 11 is a cross sectional view of a member 1002. Member 1002 has a top layer 1006 of high density foam. Bottom layer 1008 is a low density foam affixed to the top layer 1006. Epoxy 1009 is then applied to a bottom side of bottom layer 1008 to affix member 102 to fabric 1001.

A second piece of fabric 302 may then cover pad 100 and be affixed to fabric piece 304 at points 306, 307 around the perimeter of pad 100. The second piece of fabric 302 is affixed by glue, stitches, or in some other manner. Preferably, the second piece of fabric 302 is not affixed to a top side 305 of pad 100. Instead, a gap 310 is formed between pad 100 and the second piece of fabric 302. This promotes flexibility and breathability of pad 100. In a preferred embodiment, the construction shown in FIG. 3 is used for removable protective devices such as the devices shown in FIG. 6 and described below.

Figure 4:
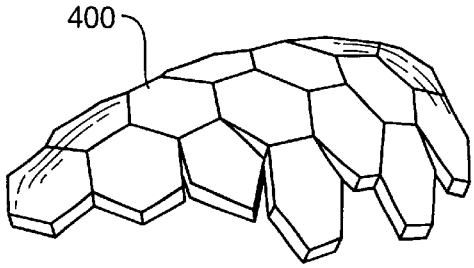
FIG. 4 illustrating a top side view of a curved pad in accordance with the invention.
Figure 5:
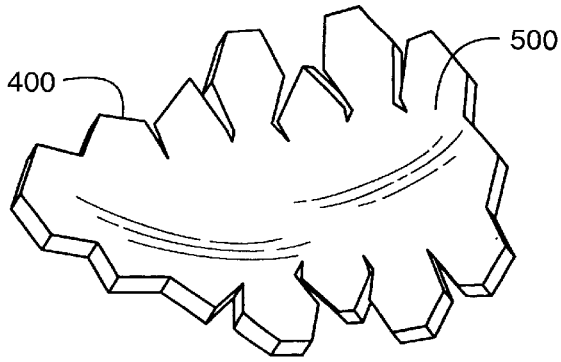
FIG. 5 illustrating a bottom side view of a curved pad in accordance with the invention.

In a preferred embodiment, pad 100 is curved to better enclose an area of articulation being protected. FIGS. 4 and 5 illustrate a curved pad 100. As can be seen from FIG. 4, in the preferred embodiment pad 100 has a curvature 400 along the second axis 120. The curvature is formed by heat molding pad 100 in the preferred embodiment. To heat mold pad 100, the energy absorbing material must be heat moldable such as the bi-density foam described above. The pad 100 also may be curved along the first axis 110, though usually, if there is such curvature, it is less than along the second axis.

FIG. 5 shows concave area 500 of an inner side of pad 100. Concave area 500 is curved to fit the area of articulation being protected into the concave area and more completely protect the area of articulation. One skilled in the art will recognize that the exact amount of curvature of pad 100 will depend on the area of articulation being protected and the amount of the area desired to be protected.

Figure 6:
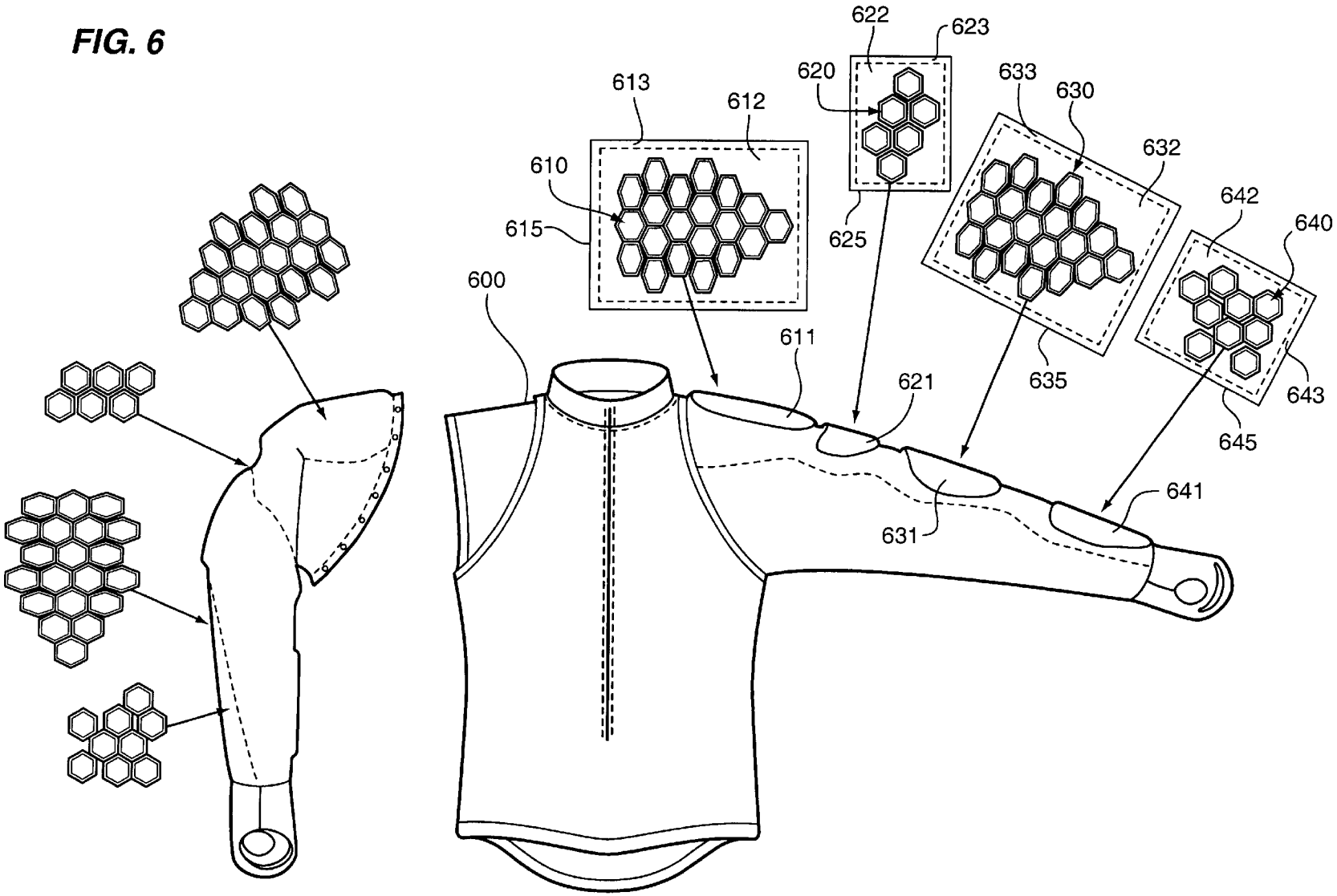
FIG. 6 illustrating an exploded view of a jacket incorporating energy absorbing pads in accordance with the invention.

FIG. 6 illustrates one type of garment that may benefit from a protective pad in accordance with the invention. Jacket 600 is a jacket worn for such activities as skiing and snowboarding. Jacket 600 includes shoulder pad 610, tricep pad 620, elbow pad 630 and forearm pad 640. Shoulder pad 610 and elbow pad 630 are substantially triangular shaped pads as the pad 100 shown in FIG. 1 and incorporate the invention. Tricep pad 620 and forearm pad 640 are smaller pads that protect areas that do not articulate and may or may not incorporate the invention.

An inner side of shoulder pad 610 is affixed to fabric 613 and a second piece of fabric 612 is then affixed to fabric 613 proximate the perimeter of fabric 613 to enclose shoulder pad 610 and to form enclosed shoulder pad 615. This process is shown in FIG. 3 and described above. Enclosed shoulder pad 615 fits into pocket 611 on the shoulder of jacket 600. One skilled in the art will recognize that pocket 611 may be sewn or glued shut or have a zipper that allows removal of shoulder pad 610.

An inner side of tricep pad 620 is affixed to fabric 623. A second piece of fabric 622 is then affixed to fabric 613 proximate the perimeter of fabric 613 to enclose tricep pad 620 and form enclosed tricep pad 625. This shown in FIG. 3 and discussed above. Enclosed tricep pad 625 fits into pocket 621 on an upper back side of a sleeve of jacket 600. Pocket 621 may be sewn or glued shut or have a zipper allowing access to remove tricep pad 620.

An inner side of elbow pad 630 is affixed to piece of fabric 633. A second piece of fabric 632 is affixed to fabric 633 proximate the perimeter of fabric 633 to enclose elbow pad 630 and to form enclosed elbow pad 635. This process is shown in FIG. 3 and described above. Enclosed elbow pad 635 fits into pocket 631 in an elbow of the sleeve of jacket 600. Pocket 631 may be sewn or glued shut or have a zipper allowing access to remove elbow pad 630.

An inner side of forearm pad 640 is affixed to piece of fabric 643. A second piece of fabric is then affixed to fabric 643 proximate the perimeter of fabric 643 to enclose forearm pad 640 and to form enclosed forearm pad 645. Enclosed forearm pad 645 fits into pocket 641 on a lower end of the sleeve of jacket 600. Pocket 641 may be sewn or glued shut or have a zipper or other fixture allowing access to remove forearm pad 640.

FIG. 7 illustrates a pair of pants 700 that incorporates protective pads in accordance with the invention. Pants 700 includes pockets 710 which receive pads 100 to provide hip protection. Pads 100 that fit into pockets 710 are preferably shaped much like pad 100 shown in FIG. 1. Pockets may have a zipper or other fastener to allow the pads to be removed. Pants 700 also may include pockets 720 that receive pads to protect a knee. As stated above, pockets 720 may have a fastener to allow removal of the pads or may be sewn or glued shut.

FIG. 8 illustrates a configuration of a knee pad in accordance with the invention. A knee pad is made of two protective pads 810 and 820 having score and cut lines in accordance with the invention. Pad 810 protects a top or upper part of a knee and has a substantially triangular end 811 the fits over a knee cap. Pad 820 protects a lower part of the knee and has an upper end 821 that is shaped to mate with part 811 of pad 810 when a knee is straight. When a knee is bent, pads 810 and 820 separate to maximize bending of the knee. Pads 810 and 820 then are fitted into pocket 720 as shown in FIG. 7.

The above description is of a protective pad in accordance with the invention. It is expected that those skilled in the art can and will design alternative pads that infringe on the invention as set forth in the claims below either literally or through the Doctrine of Equivalents.

What is claimed is:

1. An energy absorbing, articulated, protective pad comprising:

a pad of energy absorbing material;

score lines along a first axis and about a second axis wherein said score lines are cut into said pad to provide articulation of said pad; and cuts through said pad about said second axis at a periphery of said pad that provide flexibility to said pad wherein the cuts about the second axis are in two directions.

2. The energy absorbing protective pad of claim 1 wherein said energy absorbing material is a single density foam.

3. The energy absorbing protective pad of claim 1 wherein said energy absorbing material is a multi-density foam.

4. The energy absorbing protective pad of claim 3 wherein said multi-density foam comprises:

a first layer on an outer side of said pad having a first density; and a second layer on an inner side of said pad having a second density that is a higher density than said first density.

5. The energy absorbing protective pad of claim 1, further comprising a piece of stretch fabric affixed to an inner side of said pad.

6. The energy absorbing protective pad of claim 5, further comprising a piece of outer fabric affixed to said piece of stretch fabric around a perimeter of said pad to enclose said pad.

7. The energy absorbing protective pad of claim 5 wherein said score lines sever said pad into a plurality of individual members.

8. The energy absorbing protective pad of claim 1 wherein said score lines comprise:

a first plurality of score lines substantially along a first axis that is longitudinal to an area of articulation; and a second plurality of score lines substantially along a second axis that is substantially perpendicular to said first axis.

9. The energy absorbing protective pad of claim 8 wherein said first and second pluralities of score lines are cut at least one-quarter of a way through said pad.

10. The energy absorbing pad of claim 8 wherein said first and said second pluralities of score lines are cut at least one-half of a way though said pad.

11. The energy absorbing pad of claim 8, further comprising a plurality of polygons in said pad defined by said first and said second plurality of score lines.

12. The energy absorbing protective pad of claim 11 wherein each of said plurality of polygons is narrower along said first axis than along said second axis.

13. The energy absorbing protective pad of claim 11 wherein said polygons are selected from the group consisting of hexagons and pentagons.

14. The energy absorbing protective pad of claim 8 wherein said pad further comprises a curvature of said pad traversing said second axis wherein a concave side of said pad is fitted to a body part to be protected.

15. The energy absorbing protective pad of claim 14 wherein said energy absorbing material of said pad is heat moldable and heat is applied to form said curvature.

16. The energy absorbing protective pad of claim 15, further comprising a pocket in a garment that receives said pad.

17. The energy absorbing protective pad of claim 16 wherein said protective pad is a knee pad.

18. The energy absorbing protective pad of claim 16 wherein said protective pad is an elbow pad.

19. The energy absorbing protective pad of claim 16 wherein said protective pad is a hip pad.

20. The energy absorbing protective pad of claim 16 wherein said protective pad is a shoulder pad.

21. The energy absorbing pad of claim 1 wherein said cuts eliminate excess material that impedes flexing at said plurality of score lines.

22. A method for providing an energy absorbing, articulated, protective pad comprising the steps of:

defining score lines along a first axis and about a second axis of a pad of energy absorbing material wherein said score lines provide articulation of said pad; and cutting through said pad about said second axis in two directions at a periphery of said pad to provide flexibility to said pad.

23. The method of claim 22 wherein said energy absorbing material is a single density foam.

24. The method of claim 22 wherein said absorbing material is a multi-density foam.

25. The method of claim 24 wherein said multi-density foam has a first layer on a outer side of said pad having a first density and a second layer on an inner side of said pad having a second density that is a higher density than said first density.

26. The method of claim 22, further comprising the step of affixing a piece of stretch fabric to an inner side of said pad.

27. The method of claim 26, further comprising the step of affixing a piece of outer fabric to said piece of stretch fabric around a perimeter of said pad to enclose said pad.

28. The method of claim 27, further comprising the step of severing said pad into a plurality of individual members affixed to said stretch fabric with said score lines.

29. The method of claim 22 wherein said step of defining said score lines comprises the steps of:

cutting a first plurality of score lines substantially along a first axis that is longitudinal to an area of articulation; and cutting a second plurality of score lines substantially along a second axis that is substantially perpendicular to said first axis.

30. The method of claim 29 wherein said first and second pluralities of score lines are cut at least one-quarter of a way through said pad.

31. The method of claim 29 wherein said first and said second pluralities of score lines are cut at least one-half of a way though said pad.

32. The method of claim 29 further comprising the step of defining a plurality of polygons in said pad defined by said first and said second plurality of score lines.

33. The method of claim 32 wherein said step of defining comprises defining polygons selected from the group consisting of hexagons and pentagons.

34. The method of claim 33 wherein each of said plurality of polygons is narrower along said first axis than along said second axis.

35. The method of claim 22, further comprising the step of forming a curvature of said pad traversing said second axis wherein a concave side of said pad is fitted to a body part to be protected.

36. The method of claim 35 wherein said energy absorbing material of said pad is heat moldable and said method further comprises the step of applying heat to said pad to form said curvature.

37. The method of claim 22, further comprising the step of inserting said pad into a pocket in a garment that receives said pad.

38. The method of claim 37 wherein said protective pad is a knee pad.

39. The method of claim 37 wherein said protective pad is an elbow pad.

40. The method of claim 37 wherein said protective pad is a hip pad.

41. The method of claim 36 wherein said protective pad is a shoulder pad.

42. The method of claim 22 further comprising the step of:

Removing excess material between said cuts to promote flexibility along said plurality of score lines.

43. An energy absorbing, articulated protective pad comprising:

a pad of energy absorbing material; and score lines along a first axis and about a second axis wherein said score lines are cut into said pad to provide articulation of said pad, said score lines defining a plurality of polygons having a first dimension along a first axis and a second dimension along a second axis, said first dimension being smaller than said second dimension.

44. An energy absorbing protective pad as in claim 43 wherein said polygons are selected from the group consisting of hexagons and pentagons.

45. An energy absorbing, articulated, protective pad comprising:

a plurality of discrete beads of substantially elastic and resilient material, said beads being integrally joined to each other to form a pad; and score lines along a first axis and about a second axis in two directions wherein said score lines are cut into said pad to provide articulation of said pad.

46. An articulated pad as in claim 45 wherein said score lines comprise:

a first plurality of score lines substantially along said first axis that is longitudinal to an area of articulation; and a second plurality of score lines substantially about said second axis that is substantially perpendicular to said first axis.

47. The energy absorbing pad of claim 46 further comprising a plurality of polygons in said pad defined by said first and said second plurality of score lines.

48. The energy absorbing protective pad of claim 46 wherein each of said plurality of polygons is narrower along said first axis than about said second axis.

49. The energy absorbing protective pad of claim 46 wherein said polygons are selected from the group consisting of hexagons and pentagons.

* * * * *